United States Patent [19]

Rossi

[11] 4,155,399

[45] May 22, 1979

[54] METHOD FOR THE CONTINUOUS CASTING OF STEEL SLABS

[76] Inventor: Irving Rossi, Dunros Farm James St., Morristown, N.J. 07960

[21] Appl. No.: 841,900

[22] Filed: Oct. 13, 1977

[51] Int. Cl.[2] ..... B22D 11/04

[52] U.S. Cl. ..... 164/82; 164/418

[58] Field of Search ..... 164/82, 418, 443

[56] References Cited

U.S. PATENT DOCUMENTS

| | | | |
|---|---|---|---|
| 2,947,075 | 8/1960 | Schneckenburger et al. | 164/76 |
| 3,313,006 | 4/1967 | Barbe et al. | 164/443 |
| 3,522,835 | 8/1970 | Khimich et al. | 164/82 |
| 3,623,533 | 11/1971 | Khorev et al. | 164/82 |
| 3,709,285 | 1/1973 | Ruckstuhl | 164/82 |

*Primary Examiner*—Othell M. Simpson
*Assistant Examiner*—J. Reed Batten, Jr.
*Attorney, Agent, or Firm*—Hopgood, Calimafde, Kalil, Blaustein and Lieberman

[57] ABSTRACT

In processes for the continuous casting of steel slabs in which molten steel is poured continuously into the upper end of a mold having a curved mold passage and in which an embryo casting (in curved form) is withdrawn continuously from the lower end of the mold, it is known that as the steel solidifies, accumulations of impurities, such as non-metallics occur in the surface of lesser radius. It is specifically proposed to prevent the accumulation of such non-metallics at or near the surface of the casting which is of lesser radius, which is a defect of slab casting produced on the standard curved mold continuous casting machines, by maintaining such surface in continuous contact with the opposed curved surface of the mold utilizing the force of gravity or other means to maintain continuous contact betwen the surface and the mold wall in order to cool the surface continuously and intensively throughout the movement of the embryo casting through the mold.

1 Claim, 3 Drawing Figures

METHOD FOR THE CONTINUOUS CASTING OF STEEL SLABS

BACKGROUND OF THE INVENTION

This invention relates to utilizing the forces by which molten steel ejects impurities from the solidifying crystals during the solidification process in connection with the continuous casting of steel slabs in which molten steel is poured continuously into the open upper end of a chilled mold having a rectangular slab shaped mold passage extending therethrough and in which an embryo casting having a solidified outer shell surrounding a molten core is withdrawn from the lower end of said mold.

As used herein the term "slab" means a casting of indeterminate length having a width which greatly exceeds its thickness. For example, a typical cast steel slab may have a width of as much as eighty inches, more or less, and a thickness of six to nine inches.

Due to the relatively high temperatures of molten steel as compared to non-ferrous metals, and due to the increasingly greater cross section of the slab castings desired by steel companies, it was soon discovered that in continuous casting of steel a much longer cooling period was required to bring the cast strand to a state of complete solidification as compared with the other metals. This necessitated extending the length of the secondary cooling zone, which in turn necessitated a great increase in the overall height of the machines.

Various solutions of this problem were proposed, but a solution which has found general acceptance and is widely used today in the continuous casting of steel is that described in Schneckenburger U.S. Pat. No. 2,947,075. As therein described, Schneckenburger proposed to use a chilled mold having a curved mold passage extending therethrough so that the embryo casting, as withdrawn from the mold, was curved. The withdrawn curved casting then moved into and through a curved secondary cooling zone and it was then straightened and delivered to a cut-off station, thus reducing the overall height of the machine.

While the Schneckenburger proposal has been successful in solving the height problem, especially for billets, it has created another problem which is particularly troublesome in casting certain steel slabs. Thus, it has been found that during the formation of the shell of the casting within the curved mold passage, the non-metallic inclusions which are found throughout certain types of steel and particularly the aluminum oxides which occur in deoxidized or "killed steel," tend to become trapped in excessive concentration at or near the surface of the casting which is of lesser radius, sometimes referred to as the "inside" surface of the casting, due to the defects in the design of the machine which become evident when the curved mold machine is used to cast slabs, as later explained. On the other hand, it has been observed that such inclusions do not appear so close or so near the surface of the casting which is of greater radius, i.e. the "outside" surface of the casting. Since the condition of the surfaces of steel slabs is highly important in the subsequent working and fabrication of the cast steel, the presence of excessive concentrations of such inclusions at or near the inside surface of the casting is considered to be a serious detriment and it is customary to scarf off or otherwise remove the thin layer of metal on the inside surface of the slab in order to rid it of the objectionable inclusions before further processing of the cast steel is attempted. This difference in the position of the non-metallics in relation to the surface is due to the difference in cooling. That is, the more intense the cooling the greater the distance of the non-metallics from the surface, as is the case at the outside surface of the casting.

It is an object of this invention to avoid the formation of the objectionable concentrations of such inclusions, at or near the inside surface of the casting, by so controlling the cooling and solidification of the solidified shell within the mold that the said inclusions are forced away from the inside surface of the casting and into the interior of the casting where they are less harmful and at the same time avoid the deterioration of the outside surface.

SUMMARY OF THE INVENTION

According to the present invention advantage is taken of the fact that as molten metal cools and solidifies metal crystals are formed which grow inwardly, i.e., away from the surface to which coolant is applied, and that as said crystals are formed they tend to reject impurities, in this case the non-metallic inclusions which are present, and force such inclusions inwardly away from the surface and into the molten metal core. The more intensely and continuously the initial cooling and solidification of the shell of the metal takes place, the more thorough is the purging of the inclusions in this shell. On the other hand, however, if the cooling of the metal which forms this shell is interrupted, or if the rate of cooling of the metal in the shell is drastically reduced by loss of contact between the surface of the casting and the opposed surface of the mold passage, then the inclusions tend to be trapped within the solidifying metal at a shorter distance from such surface. This is particularly true if, due to shrinkage of the cross section of the slab, or to any other cause resulting in reduced cooling by loss of contact between the surface of the casting or otherwise, then the thickness of the shell from which inclusions which are ejected will be less far from the surface than if the cooling was continuous and more intense.

According to the present invention, therefore, I propose to cool the said surface of lesser radius continuously and intensively throughout the movement of the embryo casting through said mold passage so that the increased intensity of cooling tends to eject the non-metallics away from the surface. This may be accomplished by maintaining said surface of lesser radius in continuous contact with the opposed curved surface of the mold throughout the movement of the embryo casting through the mold or otherwise. Preferably this is accomplished by utilizing the force of gravity acting on the embryo shell to hold said surface of a lesser radius in contact with the opposed curved surface of the mold. For this purpose, in the preferred embodiment illustrated, the mold is tilted so that the axis of the curved mold passage is inclined from the vertical. It will be so inclined if, as hereinafter described, the mold is located above a horizontal radius line passing through the center of curvature of the mold passage. The effect of so positioning the mold as compared with the conventional position of the mold is shown in the following drawings and descriptions.

DESCRIPTION OF THE PREFERRED EMBODIMENT

Figure 1:
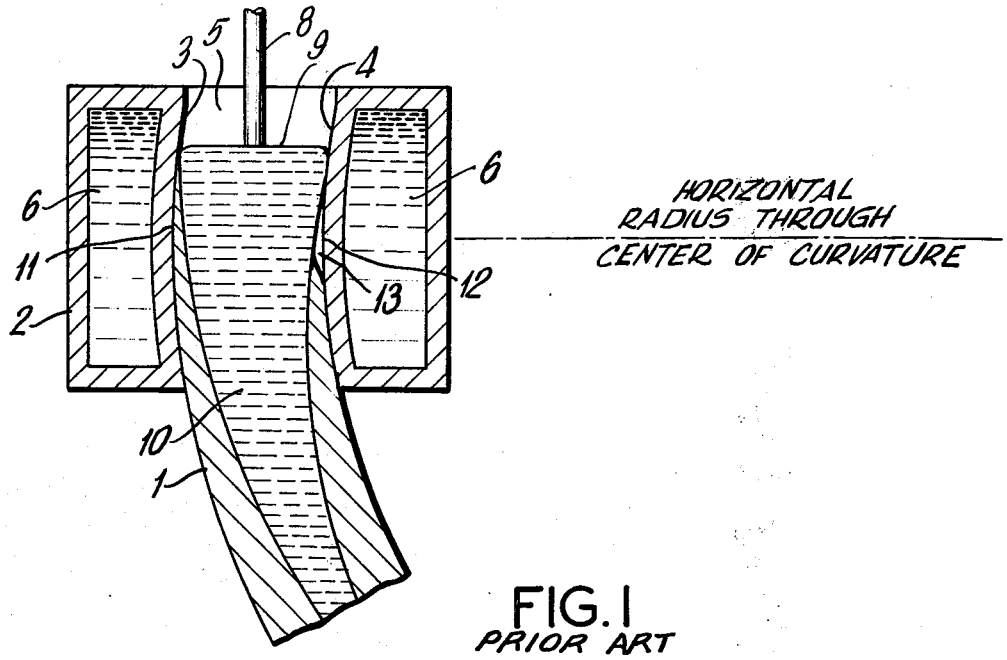
FIG. 1 PRIOR ART
FIG. 1 is a vertical cross section through the mold of a conventional curved mold steel slab casting machine of the prior art.

Referring to the drawings, FIG. 1 illustrates semi-diagrammatically a conventional form of curved mold in which an embryo casting 1 is formed in the chilled mold 2 having a curved mold passage formed by the relatively wide curved side walls 3, 4 having a common center of curvature. The relatively narrow parallel, flat end walls 5 of the mold passage are disposed vertically. Coolant is flowed through the chamber 6 which surrounds the mold passage. During the operation of the machine, molten steel is flowed continuously into the open end of the mold passage in any suitable manner in an open stream or through a down spout 8 connected to a suitable source of supply such as a tundish or a ladle to which molten metal is supplied periodically, as needed. The embryo casting formed in the mold is withdrawn by conventional withdrawal rolls at a rate commensurate with the rate at which molten metal is supplied to the mold.

As the embryo casting leaves the mold it moves into a secondary cooling zone wherein coolant is applied directly to the strand to complete the solidification of the casting pursuant to conventional practice.

The surface 9 of the molten metal 10 in the mold assumes the form of a convex meniscus, the peripheral edges of which contact the surfaces of the walls of the mold passage. Immediately below the points of contact the cooling and solidification of the molten metal begins and solidification proceeds along the mold surfaces immediately below the edge of the meniscus. The solidified metal immediately in contact with the mold is relatively thin and flexible, but the outside surface is held in contact with the mold surface 11 by the curved action of the mold and by the centrifugal action of the forward motion of the casting along the curved path as shown. This action, together with shrinkage, withdraws the newly solidified shell away from the inner wall surface 12 of the mold as indicated at 13, thereby reducing the cooling of this inner shell. Because of this action the non-metallics are trapped in a narrow shell of solidified metal, or even on the surface of the casting itself. The time of intense cooling is too short to force the non-metallics far enough inward. The increased time of contact and cooling of the outer surface of the shell positions the non-metallics far from the surface. The reduced time of contact and cooling of the inner shell positions the non-metallics close to, or at the surface of the casting.

Below this inner shell action, and thereafter, the non-metallics are correspondingly positioned as the solidification proceeds. The shell below this critical area may bulge because of ferrostatic pressure and deflection and the inner shell may resume contact with the mold, but too late to influence the position of the already trapped non-metallics.

Figure 2:
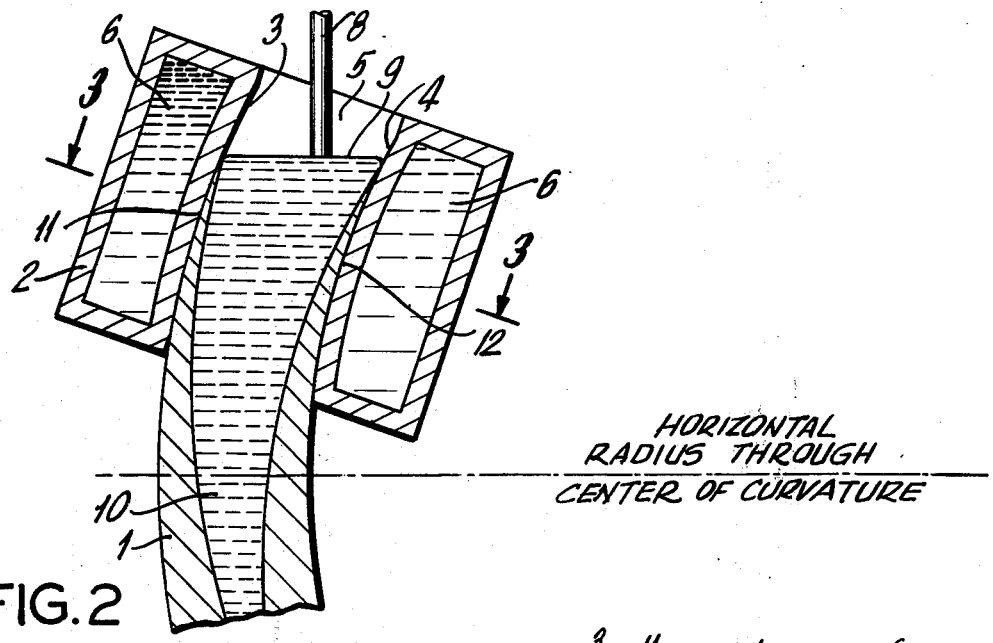
FIG. 2 is a similar cross section through the curved mold of a steel slab casting machine according to the present invention.
Figure 3:
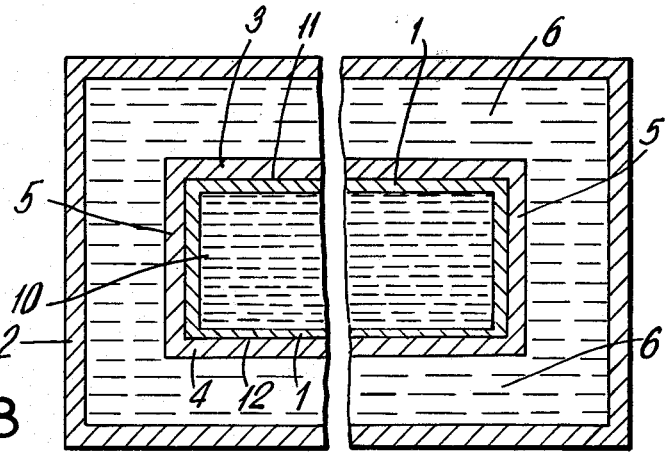
FIG. 3 is a transverse cross section on the line 3—3 of FIG. 2 illustrating the rectangular slab shape of the mold passage, the section being broken to indicate indeterminate width of the mold passage.

The formation of such a region of unstable cooling is prevented according to the present invention by causing the surface of the casting of lesser radius to maintain contact with the surface of the opposed mold wall during the critical period of initial shell formation and thereafter throughout the movement of the embryo casting through the mold, and as shown in the preferred embodiment of FIG. 2, the force of gravity is utilized for this purpose. Thus, as shown in FIG. 2, the mold is so mounted that the axis of the mold passage is tilted with respect to the vertical and to a horizontal radius extending through the common center of curvature of said curved wide side walls, and the mold is located above a horizontal radius extending through the said common center. In FIGS. 2 and 3, for convenience, the casting and mold parts are identified by the same reference numbers used in FIG. 1.

It will be observed that due to the tilting of the axis of the mold passage, the force of gravity now tends to maintain the casting surface of lesser radius in continuous contact with the curved surface of mold wall 4 as the embryo casting moves through the mold passage. On the other hand, due to the position of the curvature of the mold and because this portion of the curvature lies above the "horizon," the force of gravity acting on the outside surface of the casting can be divided into two components: (a) Vertical and (b) Horizontal. The horizontal component tends to force outside surface of the casting into contact with the mold wall and maintaining intense cooling in the critical period during which the non-metallics are ejected by the steel. The angle of tilt of the mold may be adjusted to obtain the intensity of cooling desired at the outer surface of the casting as well as at the inside surface of the casting by raising or lowering the mold to adjust the angle of tilt.

What is claimed is:

1. In a process for the continuous casting of steel slabs in which molten steel is poured continuously into the upper end of a chilled mold having a rectangular slab shaped mold passage extending therethrough and in which an embryo casting having a solidified outer shell surrounding a molten core is withdrawn continuously from the lower end of said mold passage, and in which said mold passage is curved from its upper to its lower end so that said embryo casting emerges from said mold passage in curved shape with inner and outer concentric curved surfaces of different radii defining the thickness of said slab, and with said inner curved surface being the curved surface of lesser radius, the method of preventing the accumulation of non-metallic inclusions present in said molten steel at or near the said inner curved surface of lesser radius which comprises cooling said surface of lesser radius continuously and intensively throughout the movement of the embryo casting through said mold passage by utilizing the force of gravity to maintain said surface of lesser radius in continuous contact with the opposed curved surface of the mold throughout the movement of the embryo casting through said mold passage.

* * * * *